US012139362B2

(12) United States Patent
Katafuchi

(10) Patent No.: US 12,139,362 B2
(45) Date of Patent: Nov. 12, 2024

(54) SHEET FEEDING DEVICE AND IMAGE FORMING APPARATUS

(71) Applicant: CANON KABUSHIKI KAISHA, Tokyo (JP)

(72) Inventor: Tomoki Katafuchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 17/991,966

(22) Filed: Nov. 22, 2022

(65) Prior Publication Data

US 2023/0174337 A1 Jun. 8, 2023

(30) Foreign Application Priority Data

Dec. 2, 2021 (JP) ..... 2021-195970

(51) Int. Cl.
*B65H 31/10* (2006.01)

(52) U.S. Cl.
CPC ..... *B65H 31/10* (2013.01); *B65H 2402/32* (2013.01); *B65H 2557/20* (2013.01)

(58) Field of Classification Search
CPC B65H 31/30; B65H 2402/32; B65H 2557/20; B65H 2801/06; B65H 1/14; B65H 1/04
See application file for complete search history.

(56) References Cited

U.S. PATENT DOCUMENTS

| | | | | |
|---|---|---|---|---|
| 8,297,613 | B2 | 10/2012 | Katayama | |
| 8,714,543 | B2 | 5/2014 | Matsushima et al. | |
| 10,139,773 | B2 * | 11/2018 | Ogasahara | G03G 15/6502 |
| 10,486,921 | B2 | 11/2019 | Wakiyama | |
| 11,365,075 | B2 | 6/2022 | Kimura et al. | |
| 2011/0140356 | A1 | 6/2011 | Katayama | |
| 2012/0256367 | A1 | 10/2012 | Matsushima et al. | |
| 2020/0148490 | A1 * | 5/2020 | Taba | B65H 7/02 |
| 2021/0061594 | A1 | 3/2021 | Kimura et al. | |
| 2021/0300695 | A1 | 9/2021 | Katafuchi | |

FOREIGN PATENT DOCUMENTS

| | | | |
|---|---|---|---|
| JP | 5489685 | B2 | 5/2014 |
| JP | 5832123 | B2 | 12/2015 |
| JP | 2018-197144 | A | 12/2018 |
| JP | 2021-038043 | A | 3/2021 |
| JP | 2021-050070 | A | 4/2021 |

* cited by examiner

*Primary Examiner* — Howard J Sanders
(74) *Attorney, Agent, or Firm* — Venable LLP

(57) ABSTRACT

A sheet feeding device includes a sheet stacking member, a feeding member provided above the sheet stacking member, and a lifting member to lift up and down the sheet stacking member. An accommodating unit for accommodating the sheet is provided with a supporting frame for supporting the sheet stacking member. A restricting member restricts a position of the sheet stacking member. Movement in a lifting down direction of the sheet stacking member is restricted by the restricting member when the restricting member is attached to the supporting frame in a state in which the sheet stacking member is lifted up to a predetermined position.

5 Claims, 9 Drawing Sheets

SHEET FEEDING DEVICE AND IMAGE FORMING APPARATUS

FIELD OF THE INVENTION AND RELATED ART

The present invention relates to a sheet feeding device and an image forming apparatus providing the sheet feeding device.

A conventional image forming apparatus such as a printer, a copy machine, and a facsimile machine are provided with a sheet feeding device including a sheet accommodating portion to store the sheet as a recording material on which an image is formed. A large sized image forming apparatus is constituted to comprise a detachable sheet feeding device with a large capacity to be able to supply a bulk of sheet besides of the sheet feeding device built in the image forming apparatus. In the sheet feeding device with a large capacity, a bulk of sheet stacked in a sheet stacking portion needs to be lifted up to a sheet feeding portion feeding the sheet to the main body of the image forming apparatus. In the sheet stacking portion, a wire is used for lifting up and down since a movable area that the sheet stacking portion is lifted up is increased by stacking a bulk of sheet on the sheet stacking portion. Most of the sheet feeding devices include this structure which lifts up and down the sheet stacking portion by winding and dispensing wire. The sheet stacking portion is fastened by a packaging material not to move since the sheet stacking portion may move and break in the sheet accommodating portion by vibration during transportation in the case that the wire of the sheet stacking portion is less winded when the sheet feeding device is shipping out. In the case that the sheet feeding device is run as the packaging material fastening the sheet stacking portion is not taken off after the sheet feeding device is mounted to the main body of the image forming apparatus, the packaging material may be fallen by the sheet stacking portion lifting or a driving portion may make a noise.

For example, in Japanese Patent No. 5489685, a structure of the image forming apparatus restricting the sheet stacking portion lifting when a sheet position sensor detecting a sheet on the top of the sheet stacking portion detects the packaging material fastening the sheet stacking portion is suggested. Also, in Japanese Patent No. 5832123 a structure to fasten the sheet stacking portion not to move during transportation is referred to as follows. That is, when a product is shipped out, the sheet stacking portion is lifted by winding up the wire that lifts up and down the sheet stacking portion to make the sheet stacking portion abut to a part of the sheet accommodating portion to restrict moving to lift up is suggested.

SUMMARY OF THE INVENTION

According to an aspect of the present invention, there is provided a sheet feeding device for feeding a sheet, the sheet feeding device comprising: a sheet stacking member on which the sheet is stacked; a feeding member provided above the sheet stacking member and configured to feed the sheet stacked on the sheet stacking member; a lifting member configured to lift up and down the sheet stacking member; an accommodating unit provided with a supporting frame for supporting the sheet stacking member and configured to accommodate the sheet; and a restricting member configured to restrict a position of the sheet stacking member, wherein movement in a lifting down direction of the sheet stacking member is restricted by the restricting member when the restricting member is attached to the supporting frame in a state in which the sheet stacking member is lifted up to a predetermined position.

Further features of the present invention will become apparent from the following description of exemplary embodiments with reference to the attached drawings.

DESCRIPTION OF THE EMBODIMENTS

The embodiments of the present invention will be described in detail with referring the figures in the following.

Embodiment 1

[Summary of an Image Forming Apparatus]

Figure 1:
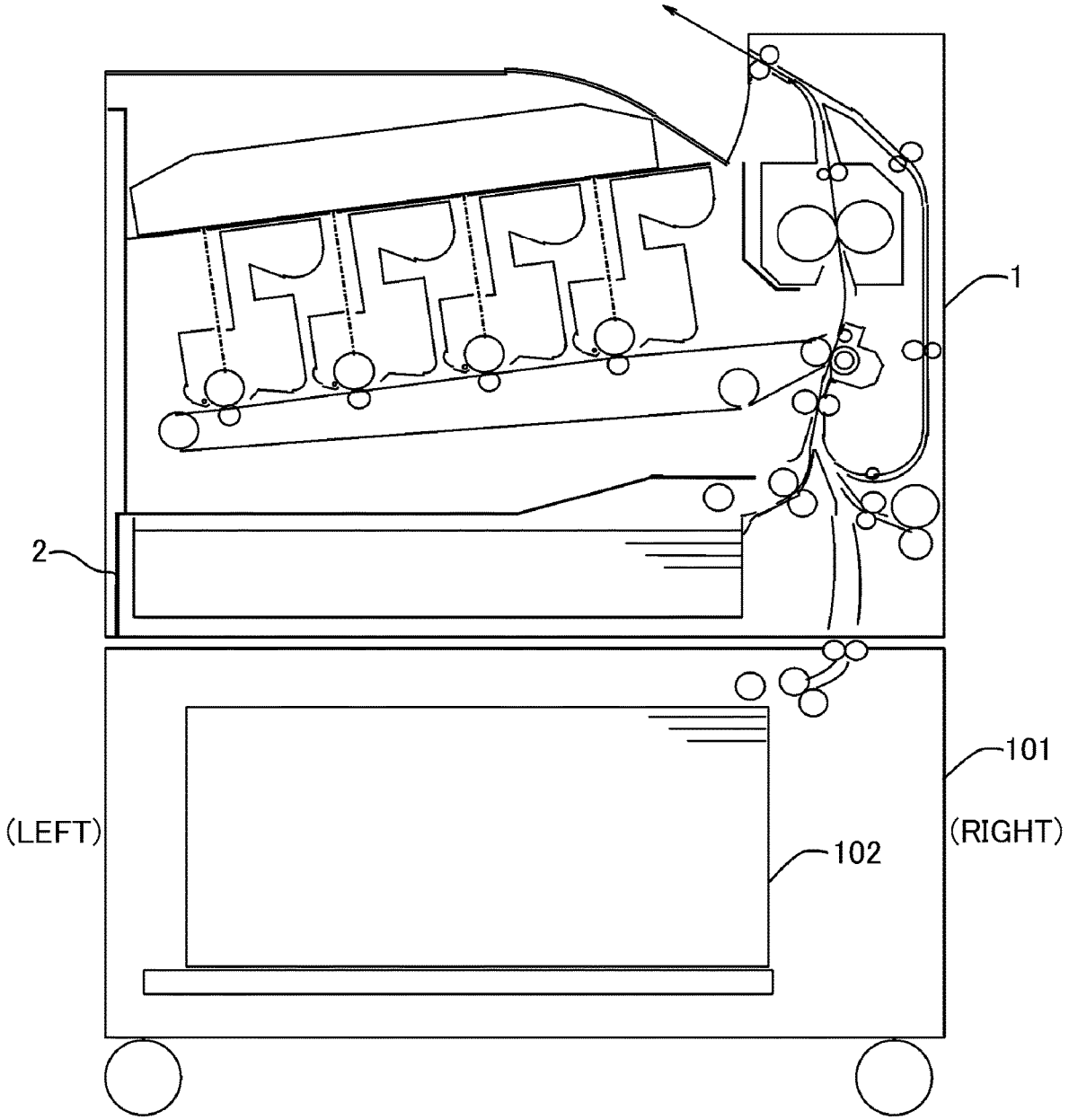
FIG. 1 is a cross-sectional view showing a structure of an image forming apparatus mounting a sheet feeding device in embodiments 1 and 2.

FIG. 1 is a cross-sectional view showing a structure of an image forming apparatus 1 mounting a sheet feeding device 101 with large capacity. The image forming apparatus 1 is a multi-color laser beam printer (hereinafter, referred as a printer) including an image forming portion where image-forming on a recording material sheet with four color toners is configured. The sheet feeding device 101 is a deck type of sheet feeding device mounted on the printer 1 including a sheet accommodating portion with a large capacity. Also, the printer 1 includes a sheet feeding device 2 inside of its main body. When the printer 1 has received a printing request from such as an outer computer (not shown in the figure), a recording material, e.g., a sheet according to the printing request is fed from the sheet accommodating portion 102 of the sheet feeding device 101 or the sheet feeding device 2. And then, an image is formed on the sheet fed in an image forming portion.

The sheet accommodating portion 102 shown in FIG. 1 is structured as detachable from the sheet feeding device 101. In the embodiment 1, a direction that the sheet accommodating portion 102 is pulled out of the sheet feeding device 101 is referred to as a 'front' side (in a foreground direction in the figure) and a direction that the sheet feed accommodating portion 102 is inserted (pushed) to mount into the sheet feeding device 101 is referred to as a 'back' side (in a depth direction in the figure). Therefore, a 'right' side is on the right as viewed from the 'front' side toward the 'back' side of the sheet feeding device 101 and a 'left' side is on the left side as viewed from the 'front' side toward the 'back' side of the sheet feeding device 101.

[Structure of the Sheet Feeding Device]

Figure 2:
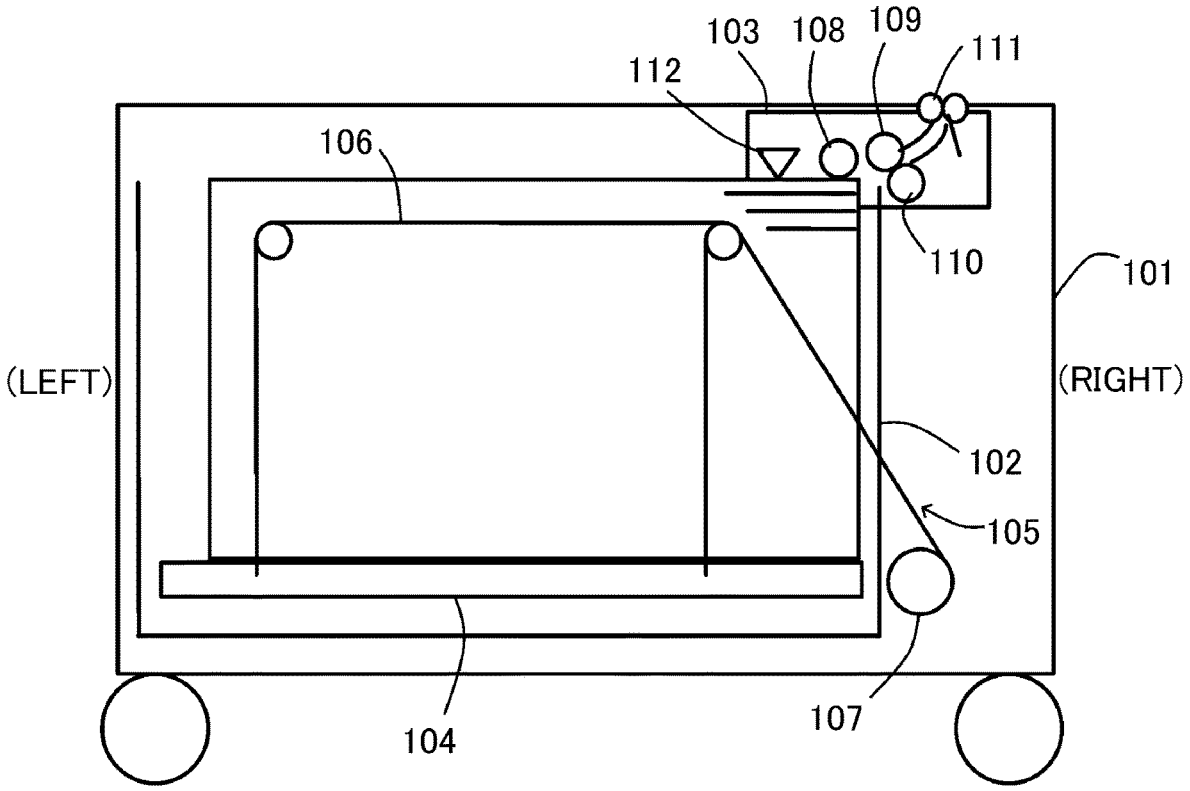
FIG. 2 is a cross-sectional view showing a structure of the sheet feeding device in the embodiments 1 and 2.

FIG. 2 is a cross-sectional view showing a structure of the sheet feeding device 101 with large capacity which is mounted on the printer 1 in FIG. 1. The sheet feeding device 101 includes the sheet accommodating portion 102 storing sheets and a sheet feeding portion 103 feeding a sheet that the sheet accommodating portion 102 is storing.

The sheet accommodating portion 102 includes a sheet stacking portion 104 stacking sheets, and a sheet moving portion 105 which is a lifting unit moving the sheet stacking portion 104 into the sheet feeding portion 103 in order to feed a sheet stacked in the sheet stacking portion 104. The sheet moving portion 105 is comprised of a wire 106 which is a lifting member fastened to the sheet stacking portion 104, a driving train 107 lifting the sheet stacking portion 104 up and down by winding and dispensing the wire 106, and so on. The driving train 107 which is a gear train is driven by a driving portion (not shown in the figure) such as a motor. Note that a structure of the sheet moving portion 105 will be described later in detail.

The sheet feeding portion 103 includes a pick-up roller 108 as a feeding member, feeding roller 109, a separating roller 110, and a conveying roller 111. The pick-up roller 108 picks up a sheet on top of the stack on the sheet stacking portion 104, and then, the feeding roller 109 and the separating roller 110 feeds and separates each sheet picked up by the pick-up roller 108 not to duplicated. The conveying roller 111 conveys a sheet to the main body of the printer 1.

Therefore, a position detecting portion 112 which is a position detecting member that detects a position of the sheet stacking portion 104 and a position of a sheet on the sheet stacking portion 104 is located near the pickup roller 108. Such as a detecting device with a photo sensor including an emitting portion emits a light and a light receiving portion detecting a light from the emitting portion and a flag shutting a light from the emitting portion interlocking an object movement is used as the position detecting portion 112. In the sheet feeding device 101, as the sheet accommodating portion 102 including the sheet stacking portion 104 stacked with a pile of sheets is attached, the sheet stacking portion is lifted by the driving train 107 in the sheet moving portion 105 winding up the wire 106. And then the sheet moving portion 105 stops lifting the sheet stacking portion 104 when the position detecting portion 112 detects that the sheet on top of the pile stacked on the sheet stacking portion 104 reaches a predetermined position where the pick-up roller 108 is able to pick up the sheet. The pick-up roller 108 picks up the sheet on the top of the pile in the predetermined position on the sheet stacking portion 104, and then the sheet is conveyed by the feeding roller 109 and the separating roller 110 to the conveying roller 111. The conveying roller 111 conveys the sheet from the feeding roller 109 and the separating roller 110 to the main body of the printer 1.

[Structure of the Sheet Accommodating Portion]

Figure 3:
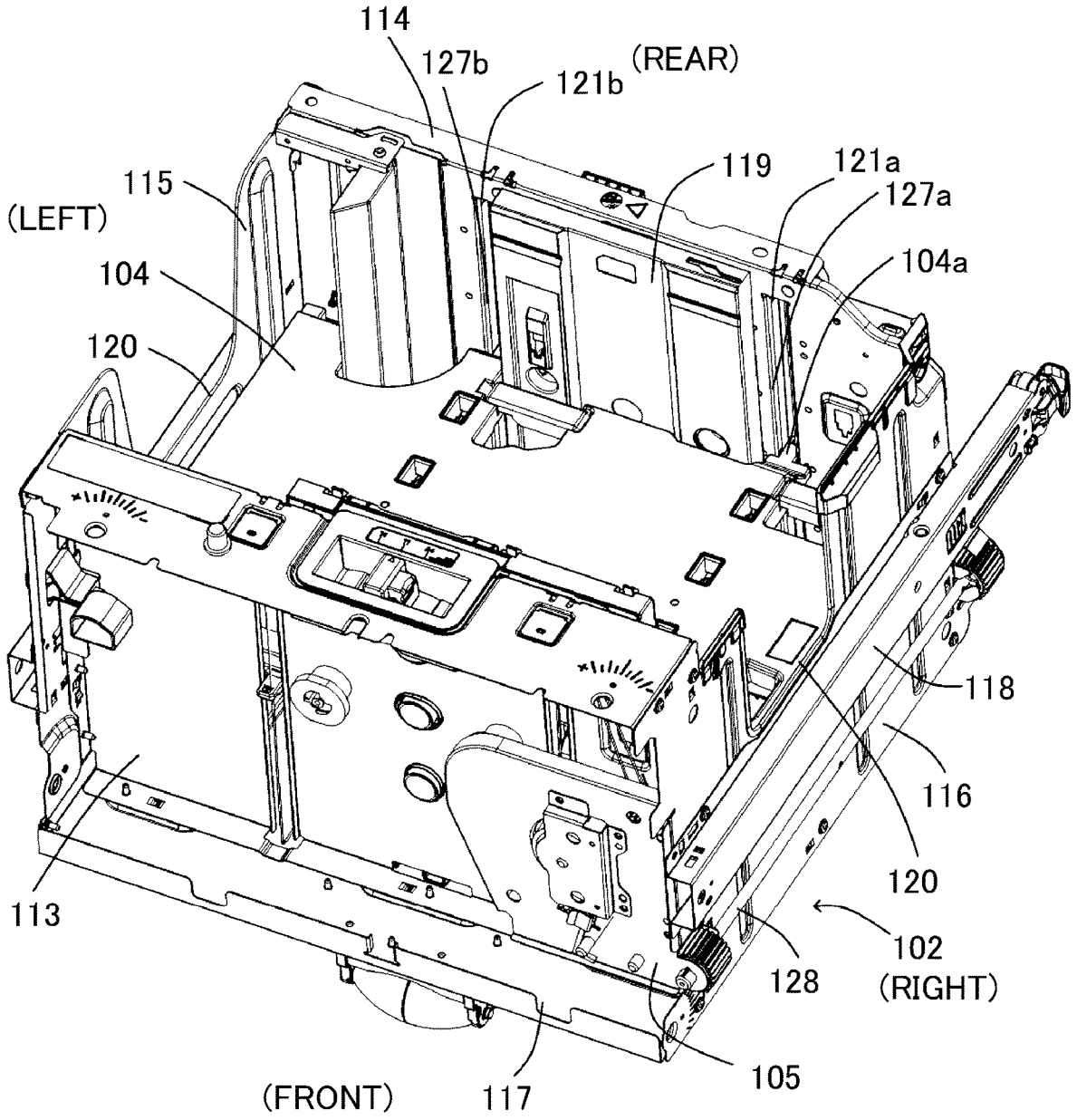
FIG. 3 is a perspective view of a structure of a sheet accommodating portion of the sheet feeding device in the embodiment 1.

Next, the sheet accommodating portion 102 in the sheet feeding device 101 will be described. FIG. 3 is a perspective view of a structure of the sheet accommodating portion 102 as the sheet accommodating portion 102 shown in FIG. 2 seen from front and above.

The sheet accommodating portion 102 is comprised of a sheet accommodating frame, a guide rail 118, the sheet stacking portion 104, a sheet guide member 119, and the sheet moving portion 105 described above. The sheet accommodating frame is comprised of a front supporting frame 113 which is a front side supporting frame constituting a frame body (casing body) of the sheet accommodating portion 102, a back supporting frame 114 of a back side, a left supporting frame 115 on a left side, a right supporting frame 116 of a right side, and a bottom board 117 of a bottom side. The guide rail 118 is attached onto the left supporting frame 115 and the right supporting frame 116 and is provided as it can slide smoothly when the sheet accommodating portion 102 is detached from the sheet feeding device 101 with moving in front and back direction in the figure. The sheet guide member 119 guides an end of the sheet to stack sheets easily when a pile of the sheets is stacked on the sheet stacking portion 104.

In both the left supporting frame 115 and the right supporting frame 116 constituting the sheet accommodating frame, a pair of opening portions 120 notching the left supporting frame 115 and the right supporting frame 116 from above in vertical direction (upper direction in the drawing) to nearby the guide rail 118 is provided. The opening portion 120 is provided to get hands grabbing sheets into (to access) inside of the sheet stacking portion 104 to stack sheets easily when sheets are stacked on the sheet stacking portion 104. The opening portion may be a notch shape or holes on both the left supporting frame 115 and the right supporting frame 116. On the back supporting frame 114 two grooves 127*a* and 127*b* are provided to guide a contact portion 104*a* provided on the sheet stacking portion 104 lifting by the sheet moving portion 105. Also, on the front supporting frame 113, two grooves 127*a* and 127*b* (not shown in figures) are provided to guide a contact portion 104*a* provided on the sheet stacking portion 104 lifting by the sheet moving portion 105 as same as the back supporting frame 114. At each end of the grooves 127*a* and 127*b* in the vertical direction, moving restricting portions 121*a* and 121*b*. with which the contact portion 104*a* is in contact when the sheet stacking portion 104 is lifted by the sheet moving portion 105 and which restrict movement of the sheet stacking portion 104 in the vertical direction. are provided.

[Structure of the Sheet Moving Portion]

Figure 4:
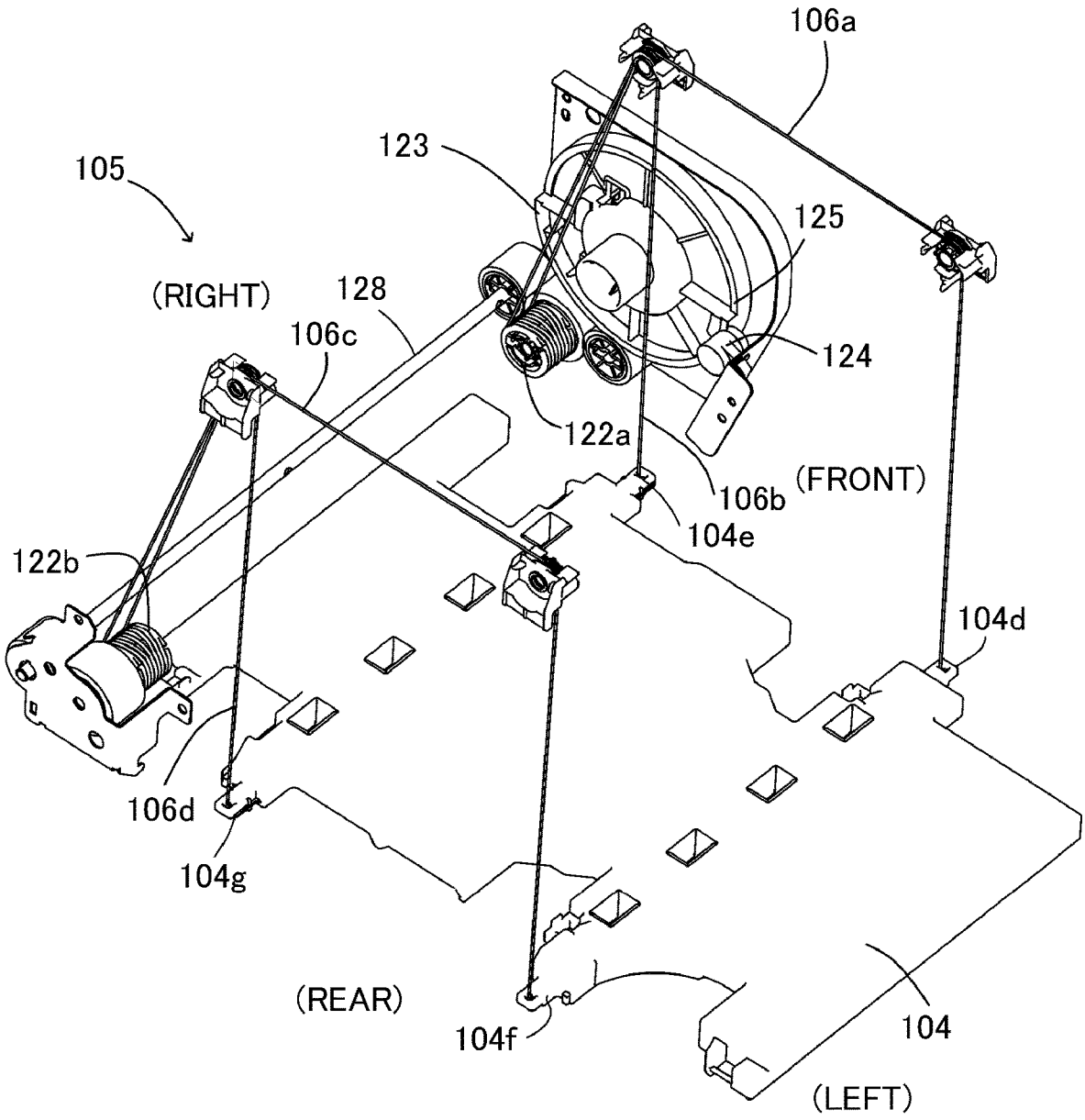
FIG. 4 is a perspective view explaining a sheet moving portion of the sheet accommodating portion in the embodiment 1.

Next, the structure of the sheet moving portion 105 will be described. FIG. 4 is showing a structure of the sheet moving portion 105 as the sheet accommodating portion 102 shown in FIG. 3 seen from left side in the back of the figure toward right side in front of the figure. Note that, in FIG. 4 some parts such as the front supporting frame 113, the back supporting frame 114, the left supporting frame 115, the right supporting frame 116, the bottom board 117, and the guide rail 118 constituting the sheet accommodating frame shown in FIG. 3 are omitted to describe the structure of the sheet moving portion 105.

As shown in FIG. 4, the sheet moving portion 105 lifting up and down the sheet stacking portion 104 is comprised of the wire 106 (from 106*a* to 106*d*) tied to the sheet stacking portion 104, a wire winding member 122*a* and 122*b*, an intermittent gear 123, and a damper gear 124. Each end of the wire 106*a*, 106*b*, 106*c*, and 106*d* is tied to a protrusion 104*d*, 104*e*, 104*f*, and 104*g* sticking out of the sheet stacking portion 104. Other ends of the wire 106*a* and 106*b* are connected to the wire winding member 122*a* storing and dispensing the wire 106. Other ends of the wire 106*c* and 106*d* are connected to the wire winding member 122*b*. As the wire winding member 122*a* is driven, both the wire 106*a* and 106*b* are winded or dispensed (sent out) in same length, therefore, the end part which is the front side of the figure of the sheet stacking portion 104 is lifted up and down. Between the wire winding member 122*a* and the wire winding member 122*b*, a drive transmitting member 128 is provided to transmit a driving power from the wire winding member 122*a* to the wire winding member 122*b*. Therefore, as the wire winding member 122*a* is driven, the wire winding member 122*b* is driven in same direction and speed, the wire 106*c* and 106*d* is winded or dispensed in same length, and an end part of back side in the figure of the sheet stacking portion 104 is lifted up and down. As a result, as the wire winding member 122*a* is driven, the sheet stacking portion 104 is lifted in the up and down direction in the drawing (vertical direction) with keeping of the horizontal state.

When the sheet accommodating portion 102 is inserted to attach to the sheet feeding device 101 along the guide rail 118, a driving power is transmitted to the driving train 107 in the sheet moving portion 105 (in FIG. 2) by a power source such as a motor (not shown in the figure). And the wire winding member 122*a* and wire winding member 112*b* are driven, the sheet stacking portion 104 is moved in vertically upward direction by winding the wire 106*a*, 106*b*, 106*c*, and 106*d*, and stops at a position on the sheet stacking portion 104 where the sheet on the top is able to be fed.

On the other hand, when the sheet accommodating portion 102 is pulled out of the sheet feeding device 101 along the guide rail 118, the driving train 107 in the sheet accommodating portion 102 is separated from the power source (not shown in the figure) of the sheet feeding device 101. Therefore, the sheet stacking 104 becomes able to move (go down) from the position on the sheet stacking portion 104 where the sheet on the top is able to be fed as the wire 106*a*, 106*b*, 106*c*, and 106*d* are dispensed from the wire winding member 122*a*, 122*b* by an own weight of the sheet stacking portion. The intermittent gear 123 and the damper gear 124 mentioned above are provided not to apply a load on the driving train 107 except the own weight of the sheet stacking portion 104. The sheet stacking portion 104 in the movable state is moved (gone down) vertically downward by its own weight. When the sheet stacking portion 104 comes down to a predetermined position, a missing teeth portion 125 of the intermittent gear 123 engages with the damper gear 124, the own weight of the sheet stacking portion 104 is not enough to dispense the wire 106*a*, 106*b*, 106*c*, and 106*d* by a load of the damper gear 124, and then the sheet stacking portion 104 is paused to go down. In a state of no sheets on the sheet accommodating portion 102, the sheet stacking portion 104 is hanged and held by the wire 106*a*, 106*b*, 106*c*, and 106*d* in a predetermined height.

[State of the Sheet Accommodating Portion at Shipping Out]

Figure 5:
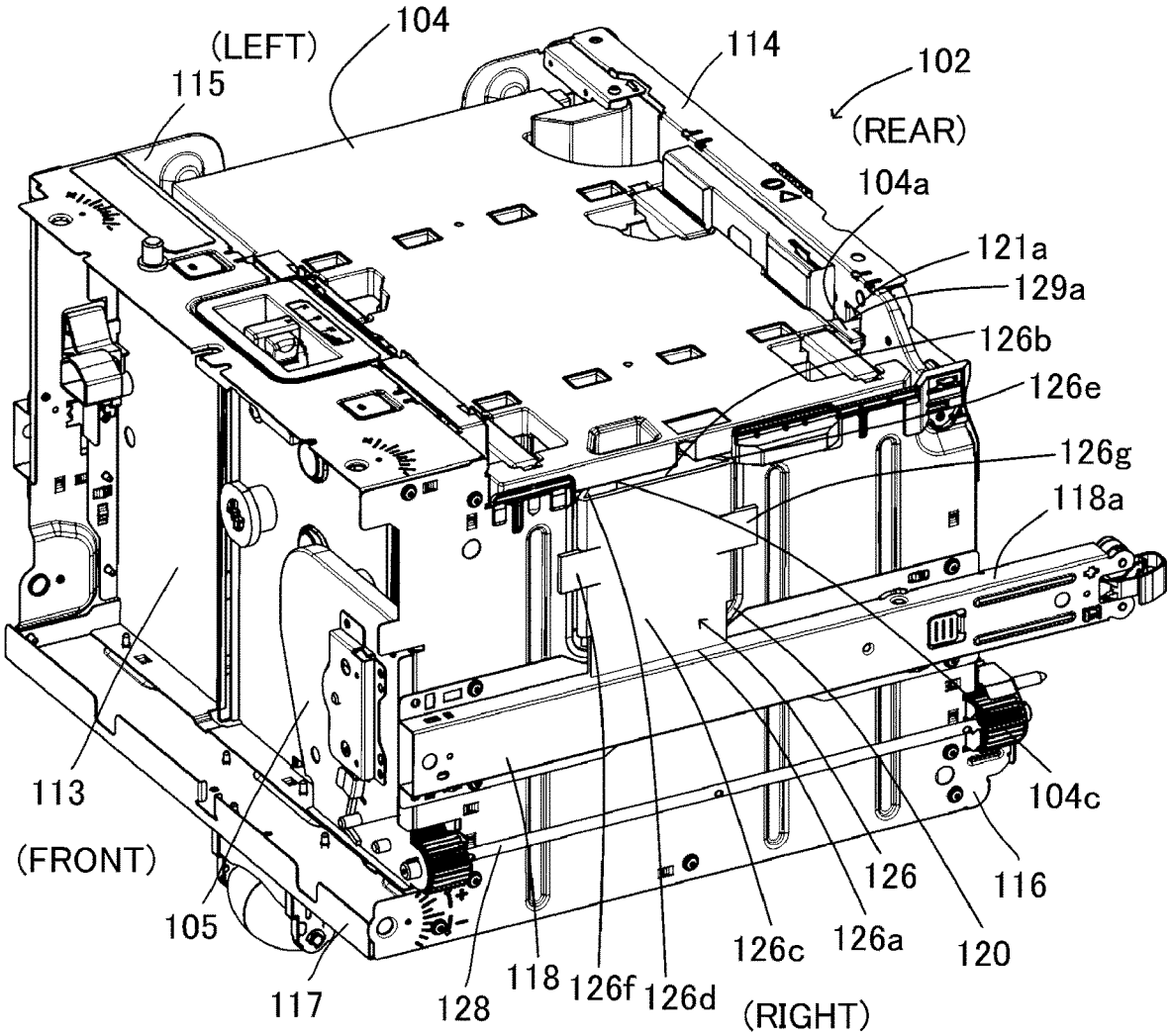
FIG. 5 is a perspective view showing a state of the sheet accommodating portion at shipping out in the embodiment 1.

Next, a state of the sheet accommodating portion 102 at shipping out will be described. FIG. 5 is a perspective view showing a state of the sheet accommodating portion at shipping out in the present embodiment. A drawing in FIG. 5 is showing the state of the sheet accommodating portion shown in FIG. 3 at shipping out.

Compared with a state of the sheet accommodating portion 102 in FIG. 3 mentioned above, in a state of the sheet accommodating portion 102 at shipping out shown in FIG. 5, the sheet stacking portion 104 is lifted upward in a vertical direction. Further, in the opening portion 120 in the right supporting frame 116, a fastening member 126 which restricts movement of the sheet stacking portion 104 is attached. Note that, in the opening portion 120 in the left supporting frame 115, the fastening member 126 which is the same shape with the one attached to the right supporting frame 116 is attached as well, though not shown in the drawing. Thus, at shipping out, after the sheet stacking portion 104 is lifted to a predetermined position of height where the fastening member 126 can be inserted (attached) to the opening portion 120 by the sheet moving portion 105, the fastening member 126 is attached to the opening portion 120, and a movement downward in the vertical direction of the sheet stacking portion 104 is restricted.

Here, a shape of the fastening member 126 will be described. Note that, though an explanation of the fastening member 126 following is about the fastening member 126 that is attached to the right supporting frame 116 side shown in FIG. 5, the fastening member 126 attached to the left supporting frame 115 is the same structure and the explanation is omitted here.

The fastening member 126 includes a shape wherein a board material (such as a thick paper or a plastic board) is processed to be a triangle shape. The fastening member 126 includes three surfaces 126*c*, 126*d*, and 126*e* and a pair of arms 126*f* and 126*g*. The surface 126*c* faces right side in the drawing. The surface 126*d* faces front side in the drawing, connects with the surface 126*c*, and is bended to make an acute angle with the back surface of the surface 126*c* (facing left side in the drawing). On the other hand, the surface 126*e* faces back side in the drawing, connects with the surface 126*c*, and is bended to make an acute angle with the back surface of the surface 126*c* (facing left side in the drawing). An upper surface 126*b*, which is an end portion of an upper part of the fastening member 126 in the vertical direction, is a top surface of the surface 126*c*, 126*d*, and 126*e* against the sheet stacking portion 104.

Also, in center of each bended end between the surface 126*c* and the surface 126*d* and 126*e*, an arm 126*g* sticking out to the front side in the drawing and an arm 126*f* sticking out to the back side in the drawing are provided. When the fastening member 126 shown in FIG. 5 is inserted through the opening portion 120 from the right to the left in the drawing to attach to the sheet accommodating portion 102, the arm 126*f* and the arm 126*g* function as stoppers by contact on the right supporting frame 116.

Further, the surface 126*c* includes a surface which is extended to the downward in vertical direction from the bended end with the surface 126*d* and 126*e*. As same as the arm 126*f* and 126*g*, the extended surface functions as a stopper by contact on the right supporting frame 116 when the fastening member 126 is inserted through the opening portion 120. Note that, a bottom surface 126*a* is an end in downward in the vertical direction (lower end) of the surface 126*c*.

As described above, the sheet stacking portion 104 is restricted to move downward by the fastening member 126 supporting as a bottom surface 104*c* of the sheet stacking portion 104 is in contact with the top surface 126*b* of the fastening member 126. On the other hand, the bottom surface 126*a* of the fastening member 126 makes a position in downward direction of the fastening member 126 by contacting with a top surface 118*a* of the guide rail 118 which is attached to the right supporting frame 116 and the left supporting frame 115 of the sheet accommodating portion 102. For that, a position of the top surface 126*b* (which is a length of the surface 126*c* in the vertical direction in the figure) of the fastening member 126 is configured as following. That is, the position of the top surface 126*b* of the fastening member 126 is configured as a height that a contacting portion 104*a* of the sheet stacking portion 104 supported by the fastening member 126 does not touch movement restricting portions 121*a* and 121*b* provided in the front supporting frame 113 and the back supporting frame 114.

Figure 6:
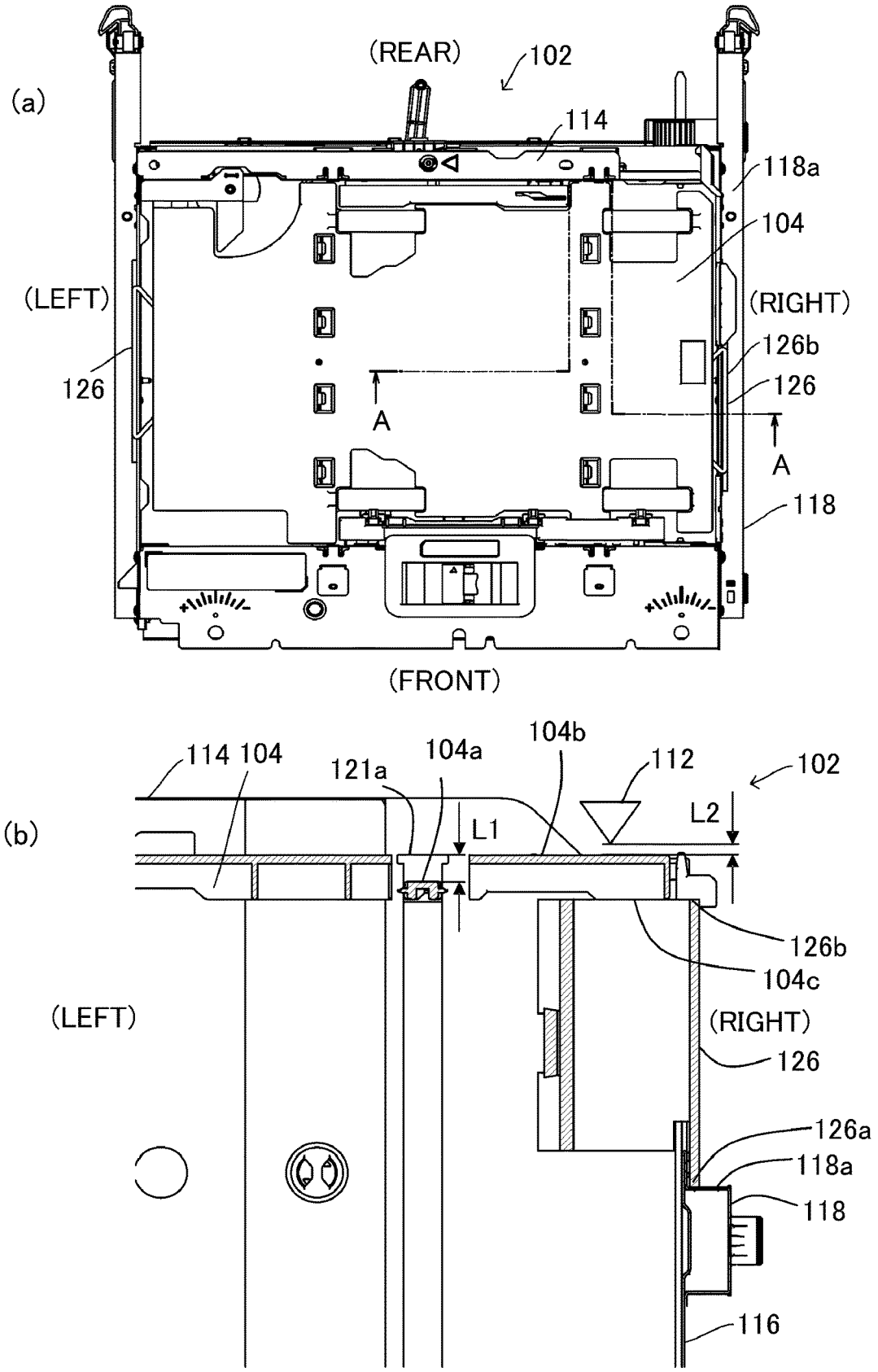
FIG. 6, part (a) and part (b), is a top view and a perspective view showing a state of the sheet accommodating portion at shipping out in the embodiment 1.

FIG. 6 (*a*) is a top view of a state of the sheet accommodating portion 102 at shipping out shown in FIG. 5 seen from upward direction. FIG. 6 (*b*) is a cross-sectional view of the sheet accommodating portion 102 as the sheet accommodating portion 102 shown in FIG. 6 (*a*) is cross-sectioned by a line A-A in FIG. 6 (*a*). As shown in FIG. 6 (*b*), it is recognized that the bottom surface 104*c* of the sheet stacking portion 104 is in contact with the top surface 126*b* of the fastening member 126. Also, it is recognized that the bottom surface 126*a* of the fastening member 126 is in contact on the top surface 118*a* of the guide rail 118 attached to the right supporting frame 116 of the sheet accommodating portion 102.

Further, in FIG. 6 (*b*) a distance between the contacting portion 104*a* of the sheet stacking portion 104 and the move restricting portion 121*a* is referred as L1 and a distance between a sheet stacking surface 104*b* of the sheet stacking portion 104 and a detectable position by the position detecting portion 112 is referred as L2. The length relation between the distance L1 and L2 is the distance L1>the distance L2 as shown in FIG. 6 (*b*). Therefore, the sheet stacking portion 104 is able to move in the vertical direction.

As described above, the sheet stacking portion 104 is only restricted to move downward in the vertical direction by the fastening member 126. On the other hand, though the sheet stacking portion 104 is able to move upward in the vertical direction, the sheet stacking portion 104 is restricted to move upward in the vertical direction within a predetermined height where the contacting portion 104*a* is in contact on the move restricting portions 121*a*, 121*b* provided in the front supporting frame 113 and back supporting frame 114. Thereby, in case that vibration or fall occurs during transportation, the sheet stacking portion 104 does not move in the sheet accommodating portion 102. Further, in case that a user starts the sheet feeding device 101 without removing the fastening member 126, the sheet stacking portion 104 is restricted to move downward by the fastening member 126, but is able to move upward in the vertical direction. The sheet stacking portion 104 is moved upward in the vertical direction by the sheet moving portion 105, but is stopped lifting by the position detecting portion 112 provided in the sheet feeding portion 103 detecting the sheet stacking portion 104. Furthermore, in case the sheet stacking portion 104 is in a detectable position by the position detecting portion 112 at the sheet feeding device starting, the sheet moving portion 105 does not execute to move upward in the vertical direction. That is, as the position detecting portion 112 detects that the sheet stacking portion 104 is in a position where is the same height as the pick-up roller 108 is able to pick up a sheet, the sheet moving portion 105 does not execute to move upward in the vertical direction. Therefore, in case conventionally occurs the user forgets to remove the fastening member, a noise made from the driving portion or a fall off the fastening member by the power of lifting the sheet stacking portion can be prevented.

As described above, by the structure of the sheet accommodating portion 102 in the present embodiment, it is not necessary for the sheet feeding device 101 in the present embodiment to use the fastening member with high quality because of the position detecting means with the high accuracy of detecting. Also, the sheet stacking portion can keep fastening state with the fastening member without falling by the detachable sheet accommodating portion in case the connection with the power source is released.

As described above, according to the present embodiment, a cost of the fastening member fastening the sheet stacking portion can be decreased and a workability in shipping out can be improved.

Embodiment 2

In an embodiment 2 a method of fastening the sheet stacking portion at shipping out of the sheet feeding device provided the sheet accommodating portion which is different from the embodiment 1. Note that, the sheet feeding device and the image forming apparatus is the same as the embodiment 1 and the descriptions of the members including the same functions with the embodiment 1 are omitted.

[Structure of the Sheet Accommodating Portion]

Figure 7:
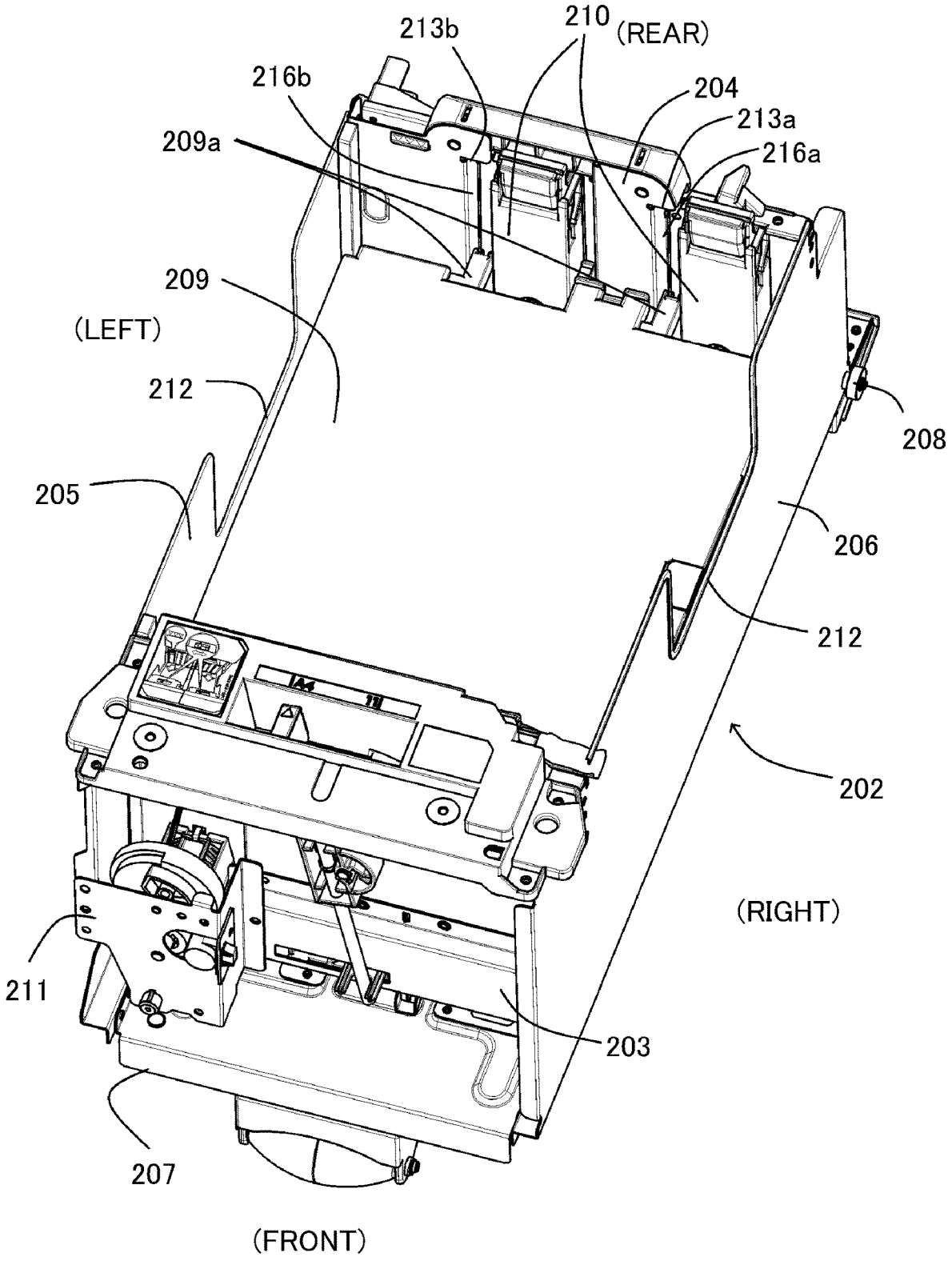
FIG. 7 is a perspective view of a structure of a sheet accommodating portion of the sheet feeding device in the embodiment 2.

A sheet accommodating portion 202 in the present embodiment will be described. The sheet accommodating portion 202 is the sheet accommodating portion storing sheets on a sheet stacking portion which includes a structure which is detachable from the sheet feeding device shown in FIG. 1 as same as the sheet accommodating portion 1 in the embodiment 1. FIG. 7 is a perspective view describing a structure of the sheet accommodating portion 202 in the present embodiment and is a perspective view of the sheet accommodating portion 202 shown in FIG. 2 seen from an upper direction of a front side of the sheet accommodating portion.

In the embodiment 2, a direction that the sheet accommodating portion 202 is pulled out of the sheet feeding device 101 is referred to as a 'front' side (in a foreground direction in the figure) and a direction that the sheet feed accommodating portion 202 is inserted (pushed) to attach to the sheet feeding device 101 is referred to as a 'back' side (in a depth direction in the figure). Therefore, a 'right' side is on the right as viewed from the 'front' side toward the 'back' side of the sheet feeding device 101 and a 'left' side is on the left side as viewed from the 'front' side toward the 'back' side of the sheet feeding device 101.

The sheet accommodating portion 202 comprises a sheet accommodating frame, a rail roller 208, a sheet stacking portion 209, a sheet guide member 210, and a sheet moving portion 211. Note that, a structure of the sheet moving portion 211 is the same with the structure described in FIG. 4 in the embodiment 1 and the description will be omitted. The sheet accommodating frame is comprised of a front supporting frame 203 which is a front side supporting frame constituting a frame body (casing body) of the sheet accommodating portion 202, a back supporting frame 204, a left supporting frame 205, a right supporting frame 206, and a bottom board 207. The rail roller 208 is attached onto the left supporting frame 205 and the right supporting frame 206 provided as it can slide smoothly when the sheet accommodating portion 202 is detached from the sheet feeding device 101 with moving in front and back direction in the figure. The sheet guide member 210 guides an end of the sheet to stack sheets easily when a pile of the sheet is stacked on the sheet stacking portion 209.

In center of each the left supporting frame 205 and the right supporting frame 206 constituting the sheet accommodating frame, an opening portion 212 notching the left supporting frame 115 and the right supporting frame 116 from above in vertical direction (upper direction in the drawing) to nearby the center of the vertical direction. The opening portion 120 is provided to get hands grabbing sheets into (to access) inside of the sheet stacking portion 209 to stack sheets easily when sheets are stacked on the sheet stacking portion 209. On the back supporting frame 114 two grooves 216*a* and 216*b* are provided to guide a contact portion 209*a* provided on the sheet stacking portion 209 lifting by the sheet moving portion 211. Also, on the front supporting frame 203 two grooves 216*a* and 216*b* are provided as well to guide a contact portion 209*a* provided on the sheet stacking portion 209 lifting by the sheet moving portion 211 as same as the back supporting frame 204. At each end of the grooves 216*a* and 217*b* in the vertical direction, moving restricting portions 213*a* and 213*b*, with which the contact portion 209*a* is contact on when the sheet stacking portion 209 is lifted by the sheet moving portion 211 and which restrict movement of the sheet stacking portion 209 in the vertical direction, are provided.

[State of the Sheet Accommodating Portion at Shipping Out]

Figure 8:
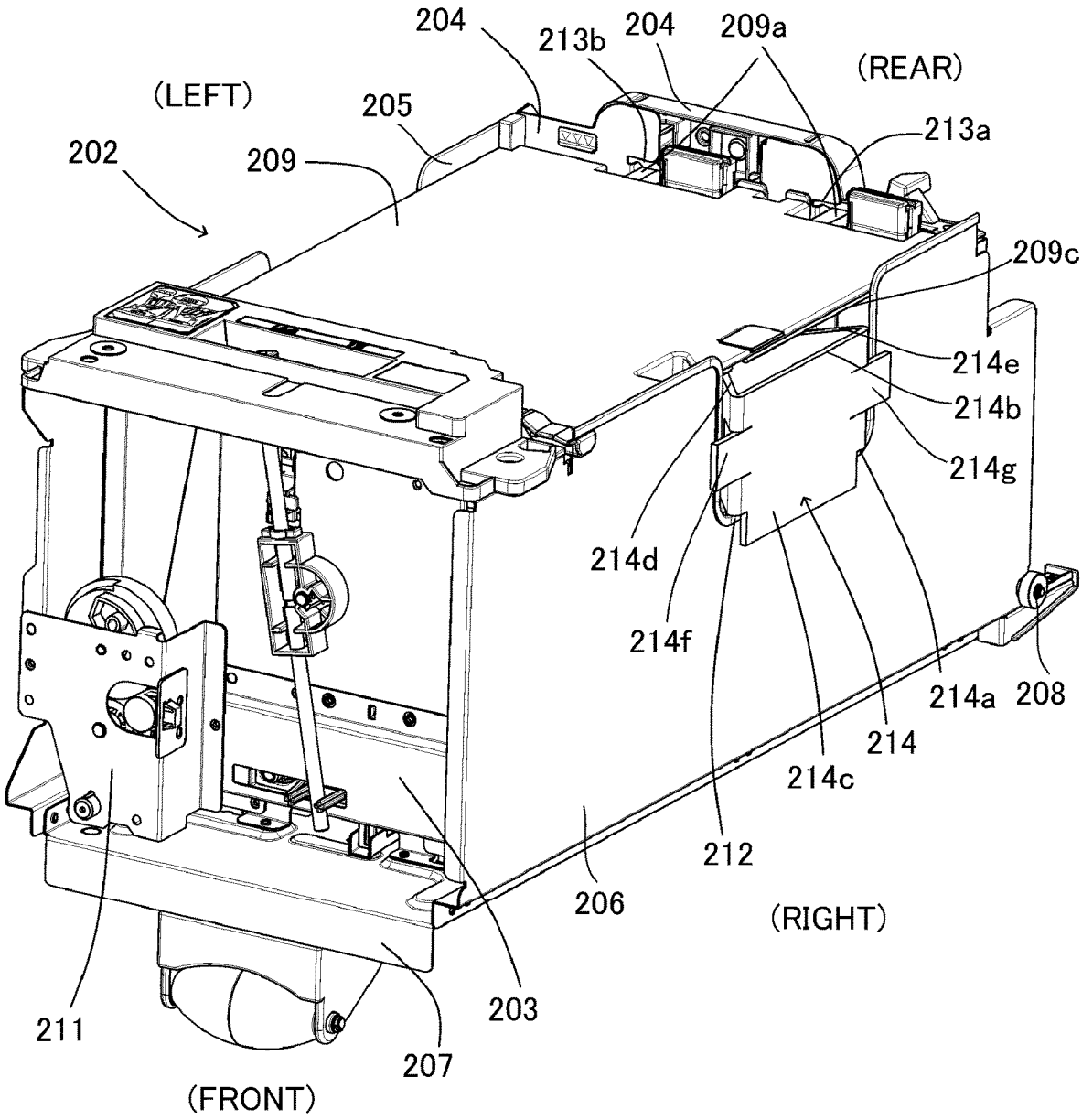
FIG. 8 is a perspective view explaining a sheet moving portion of the sheet accommodating portion in the embodiment 2.

Next, a state of the sheet accommodating portion 202 at shipping out will be described. FIG. 8 is a perspective view showing a state of the sheet accommodating portion 202 at shipping out in the present embodiment. A drawing in FIG. 8 is showing the state of the sheet accommodating portion 202 shown in FIG. 7 at shipping out.

Compared with a state of the sheet accommodating portion 202 in FIG. 7 mentioned above, in a state of the sheet accommodating portion 202 at shipping out shown in FIG. 8 the sheet stacking portion 209 is lifted upward in a vertical direction. Further, in the opening portion 212 in the right supporting frame 206 a fastening member 214 which restricts movement of the sheet stacking portion 209 is attached. Note that, in the opening portion 212 in the left supporting frame 205 the fastening member 214 which is the same shape with the one attached to the right supporting frame 206 is attached as well, though not shown in the drawing. Thus, at shipping out, after the sheet stacking portion 104 is lifted to a predetermined position of height where the fastening member 214 can be inserted to the opening portion 212 by the sheet moving portion 211, the fastening member 214 is attached to the opening portion 212 and a movement downward in the vertical direction of the sheet stacking portion 209 is restricted.

Here, a shape of the fastening member 214 will be described. Note that, though an explanation of the fastening member 214 following is about the fastening member 214 that is attached to the right supporting frame 206 side shown in FIG. 8, the fastening member 214 attached to the left supporting frame 205 is the same structure and the explanation is omitted here.

The fastening member 214 includes a shape that a board material (such as a thick paper or a plastic board) is processed to be a triangle shape. The fastening member 214 includes three surfaces 214*c*, 214*d*, and 214*e* and a pair of arms 214*f* and 214*g*. The surface 214*c* faces right side in the drawing. The surface 214*d* faces front side in the drawing, connects with the surface 214*c*, and is bended to make an acute angle with the back surface of the surface 214*c* (facing left side in the drawing). On the other hand, the surface 214*e* faces back side in the drawing, connects with the surface 214*c*, and is bended to make an acute angle with the back surface of the surface 214*c* (facing left side in the drawing). A top surface 214*b*, which is an end portion of an upper part of the fastening member 214 in the vertical direction, is a top surface of the surface 214*c*, 214*d*, and 214*e* against the sheet stacking portion 209.

Also, in center of each bended end between the surface 214*c* and the surface 214*d* and 214*e*, an arm 214*g* sticking out to the front side in the drawing and an arm 214*f* sticking out to the back side in the drawing are provided. When the fastening member 214 shown in FIG. 8 is inserted through the opening portion 212 from the right to the left in the drawing to attach to the sheet accommodating portion 202, the arm 214*f* and the arm 214*g* function as stoppers by contacting on the right supporting frame 206.

Further, the surface 214*c* includes a surface which is extended to the downward in vertical direction from the bended end with the surface 214*d* and 214*e*. As same as the arm 214*f* and 214*g*, the extended surface functions as a stopper by contacting on the right supporting frame 206 when the fastening member 214 is inserted through the opening portion 212. Note that, a bottom surface 214*a* is an end in downward in the vertical direction (lower end) of the surface 214*c*.

As described above, the sheet stacking portion 209 is restricted to move downward by the fastening member 214 supporting as a bottom surface 209*c* of the sheet stacking portion 209 is in contact with the top surface 214*b* of the fastening member 214. On the other hand, the bottom surface 214*a* of the fastening member 214 makes a position in downward direction of the fastening member 214 by contacting with the opening portion 212 provided to the right supporting frame 206 and the left supporting frame 205 of the sheet accommodating portion 202. For that, a position of the top surface 214*b* (which is a length of the surface 214*d*, 214*e* in the vertical direction in the drawing) of the fastening member 214 is configured as following. That is, the position of the top surface 214*b* of the fastening member 214 is configured as a height that a contacting portion 209*a* of the sheet stacking portion 209 supported by the fastening member 214 does not touch movement restricting portions 213*a*, 213*b* provided in the front supporting frame 203 and the back supporting frame 204.

Figure 9:
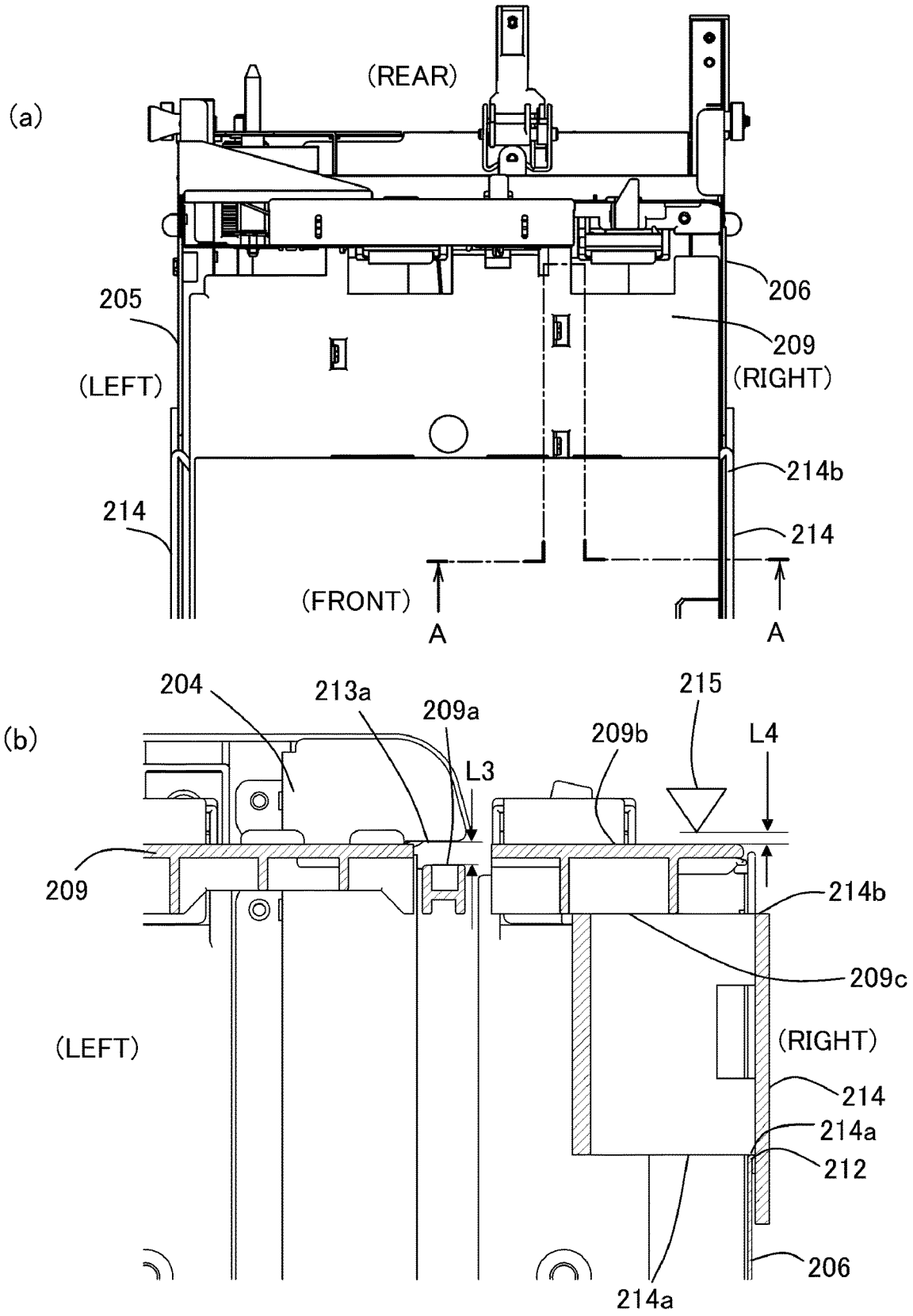
FIG. 9, part (a) and part (b), is a top view and a perspective view showing a state of the sheet accommodating portion at shipping out in the embodiment 2.

FIG. 9 (*a*) is a top view of a state of the sheet accommodating portion 202 at shipping out shown in FIG. 8 seen from upward direction. FIG. 9 (*b*) is a cross-sectional view of the sheet accommodating portion 202 as the sheet accommodating portion 202 shown in FIG. 9 (*a*) is cross-sectioned by a line A-A in FIG. 9 (*a*). As shown in FIG. 9 (*b*), it is recognized that the bottom surface 209*c* of the sheet stacking portion 209 is in contact with the top surface 214*b* of the fastening member 214. Also, it is recognized that the bottom surface 214*a* of the fastening member 214 is contact on the opening portion 212 in the right supporting frame 206 of the sheet accommodating portion 202.

Further, in FIG. 9 (*b*), a distance between the contacting portion 209*a* of the sheet stacking portion 209 and the move restricting portion 213*a* is referred to as L3, and a distance between a sheet stacking surface 209*b* of the sheet stacking portion 209 and a detectable position by the position detecting portion 215 is referred to as LA. The length relation between the distance L3 and LA is the distance L3>the distance LA as shown in FIG. 9 (*b*). Therefore, the sheet stacking portion 104 is able to move in the vertical direction.

As described above, the sheet stacking portion 104 is only restricted to move downward in the vertical direction by the fastening member 214. On the other hand, though the sheet stacking portion 209 is able to move upward in the vertical direction, the sheet stacking portion 209 is restricted to move upward in the vertical direction within a predetermined height where the contacting portion 209*a* is contact on the move restricting portion 213*a*, 213*b* provided in the front supporting frame 203 and back supporting frame 204. Thereby, in case that vibration or fall occurs during transportation, the sheet stacking portion 209 does not move in the sheet accommodating portion 202. Further, in case that a user starts the sheet feeding device 101 without removing the fastening member 214, the sheet stacking portion 209 is restricted to move downward by the fastening member 214, but is able to move upward in the vertical direction. The sheet stacking portion 209 is moved upward in the vertical direction by the sheet moving portion 211, but is stopped lifting by the position detecting portion 215 provided in the sheet feeding portion 103 detecting the sheet stacking portion 209. Furthermore, in case the sheet stacking portion 209 is in a detectable position by the position detecting portion 215 at the sheet feeding device 101 starting, the sheet moving portion 211 does not execute to move upward in the vertical direction. Therefore, in case conventionally occurs the user forgets to remove the fastening member, a noise made from the driving portion or a fall off the fastening member by the power of lifting the sheet stacking portion can be prevented.

As described above, by the structure of the sheet accommodating portion 202 in the present embodiment, it is not necessary for the sheet feeding device 101 in the present embodiment to use the fastening member with high quality because of the position detecting means with the high accuracy of detecting. Also, the sheet stacking portion can keep fastening state with the fastening member without falling by the detachable sheet accommodating portion in case the connection with the power source is released.

As described above, according to the present embodiment, a cost of the fastening member fastening the sheet stacking portion can be decreased and a workability in shipping out can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-195970, filed on Dec. 2, 2021, which is hereby incorporated by reference herein in its entirety.

What is claimed is:

1. A sheet feeding device for feeding a sheet, the sheet feeding device comprising:

a sheet stacking member on which the sheet is stacked;

a feeding member provided above the sheet stacking member and configured to feed the sheet stacked on the sheet stacking member;

a lifting member configured to lift up and down the sheet stacking member;

an accommodating unit provided with a supporting frame for supporting the sheet stacking member and configured to accommodate the sheet; and a restricting member configured to restrict a position of the sheet stacking member, wherein movement in a lifting down direction of the sheet stacking member is restricted by the restricting member when the restricting member is attached to the supporting frame in a state in which the sheet stacking member is lifted up to a predetermined position, wherein the supporting frame is provided with an opening portion, wherein the restricting member is attached to the opening portion, wherein the accommodating unit is dismountably mounted to a mounting portion of the sheet feeding device, wherein the supporting frame is provided with a guide rail configured to guide the accommodating unit, and wherein when the restricting member is attached to the opening portion, the restricting member contacts the guide rail and the restricting member is supported by the guide rail.

2. A sheet feeding device according to claim 1, wherein an upper end of the restricting member attached to the opening portion contacts the sheet stacking member, and wherein the predetermined position is a height adding (1) a height of the guide rail attached to the supporting frame to (2) a height from the upper end of the restricting member to the guide rail.

3. A sheet feeding device according to claim 1, wherein the restricting member is provided with a contacting portion which contacts the opening portion when the restricting member is attached to the opening portion, and wherein the restricting member is supported by the opening portion via the contacting portion.

4. A sheet feeding device according to claim 3, wherein an upper end of the restricting member attached to the opening portion contacts the sheet stacking member, and wherein the predetermined position is a height adding (1) a height of the opening portion to (2) a height from the upper end of the restricting member to the contacting portion.

5. A sheet feeding device according to claim 1, wherein the predetermined position is a height less than or equal to a height of a feedable position where the feeding member is capable of feeding the sheet stacked on the sheet stacking member.

* * * * *